US007765893B2

(12) United States Patent
Choi

(10) Patent No.: US 7,765,893 B2
(45) Date of Patent: Aug. 3, 2010

(54) PEDAL EQUIPPED WITH DISPLACEMENT DETECTING SENSOR USING LIKE MAGNETIC POLES

(76) Inventor: Kwang Ju Choi, 402ho, 503dong, Baeksong Maeul, 1190, Baekseok-dong Ilsan-gu, Goyang-si, Gyeonggi-do 411-720 (KR)

( * ) Notice: Subject to any disclaimer, the term of this patent is extended or adjusted under 35 U.S.C. 154(b) by 387 days.

(21) Appl. No.: 11/918,706

(22) PCT Filed: Jun. 28, 2006

(86) PCT No.: PCT/KR2006/002506

§ 371 (c)(1),
(2), (4) Date: Oct. 16, 2007

(87) PCT Pub. No.: WO2007/001557

PCT Pub. Date: Jan. 4, 2007

(65) Prior Publication Data

US 2009/0120232 A1 May 14, 2009

(30) Foreign Application Priority Data

Jun. 28, 2005 (KR) ..... 20-2005-0018720 U
Jun. 13, 2006 (KR) ..... 10-2005-0052856

(51) Int. Cl.
*G05G 1/30* (2008.04)

(52) U.S. Cl. ..... 74/560

(58) Field of Classification Search ..... 74/512, 74/513, 560, 561
See application file for complete search history.

(56) References Cited

U.S. PATENT DOCUMENTS

| | | | | |
|---|---|---|---|---|
| 2,836,990 | A * | 6/1958 | De Heer | 74/513 |
| 3,166,950 | A * | 1/1965 | Pomeranz | 74/526 |
| 3,241,394 | A * | 3/1966 | Rubenstein | 74/512 |
| 5,934,152 | A * | 8/1999 | Aschoff et al. | 74/513 |
| 6,426,619 | B1 * | 7/2002 | Pfaffenberger et al. | 324/207.2 |

FOREIGN PATENT DOCUMENTS

| | | |
|---|---|---|
| EP | 1081390 A2 | 3/2001 |
| JP | 10-147724 | 6/1998 |
| JP | 2000-280872 | 10/2000 |
| JP | 2001-253326 | 9/2001 |

* cited by examiner

*Primary Examiner*—Vicky A Johnson
(74) *Attorney, Agent, or Firm*—Park & Associates IP Law LLC

(57) ABSTRACT

Disclosed herein is a pedal equipped with a displacement detecting sensor using like magnetic poles. The pedal includes a pedal unit, a shock-absorbing unit, a sensor inserting unit, a rod unit, and a sensing unit. The pedal unit includes a support plate, an actuating pedal coupled to the support plate, a shock-absorbing hinge, and a coupling hinge. The shock-absorbing unit includes a shock-absorbing mounting part, support shafts provided in shock-absorbing cylinders, and shock-absorbing springs. The sensor inserting unit includes an insertion housing in a center of the shock-absorbing unit, an upper permanent magnet seated in an upper support seat, a lower permanent magnet seated in a lower support seat, and a sensor support. The rod unit includes a rod mounting part having a rod mounting hole, and cylindrical insertion rods. The sensing unit includes a sensor housing at a center in the rod unit, and a displacement sensor.

3 Claims, 4 Drawing Sheets

[Fig. 1]
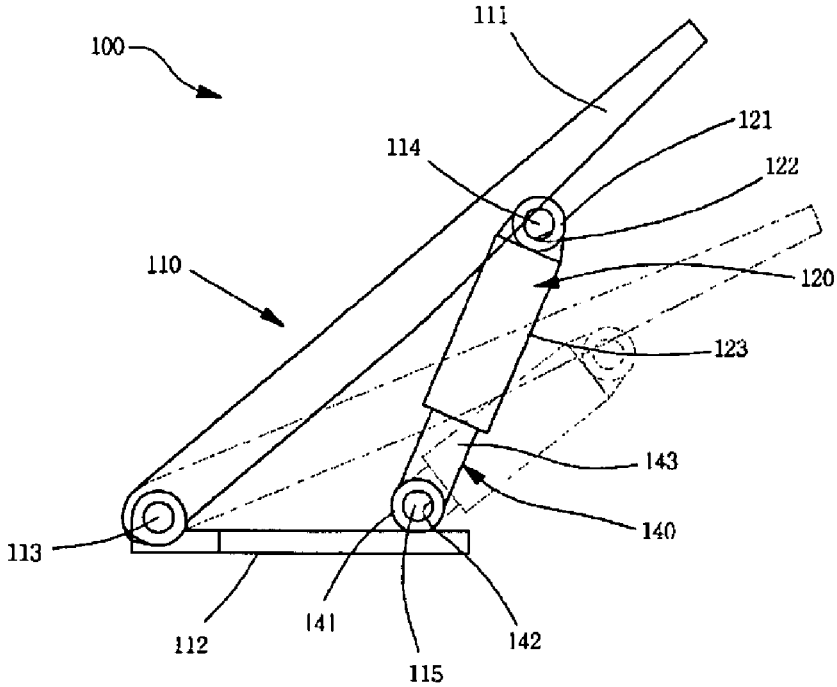
[Fig. 2]
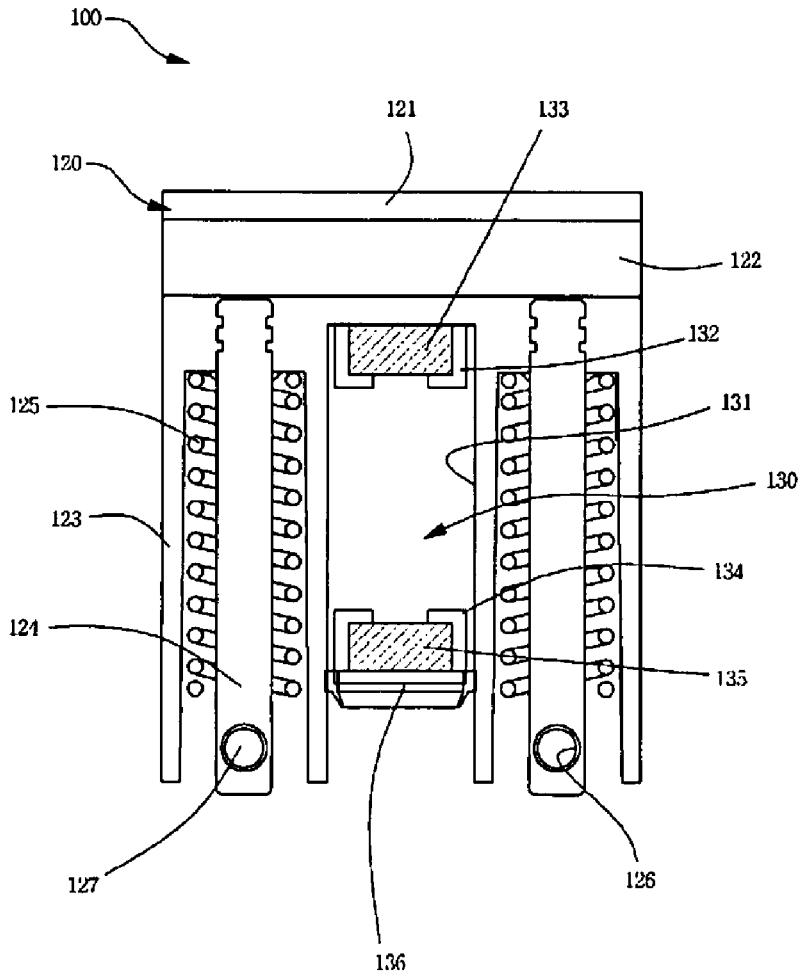

[Fig. 3]
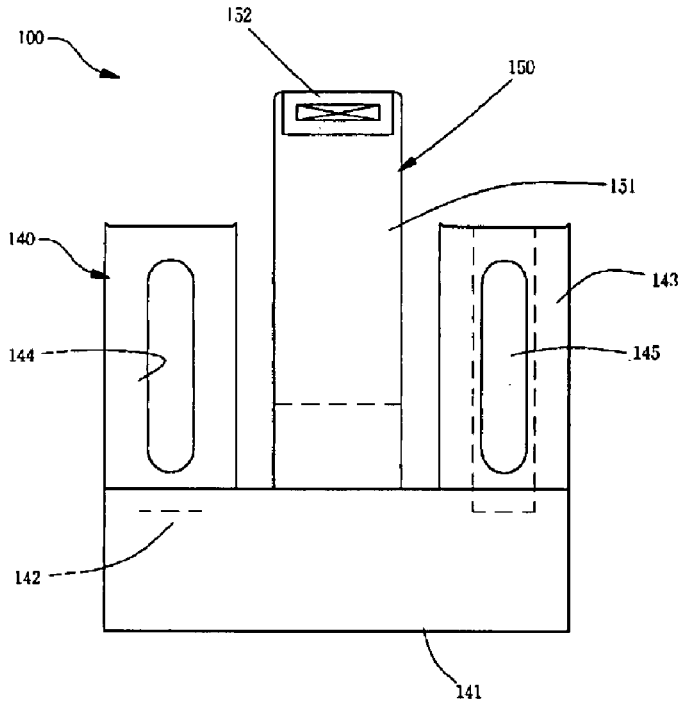
[Fig. 4]
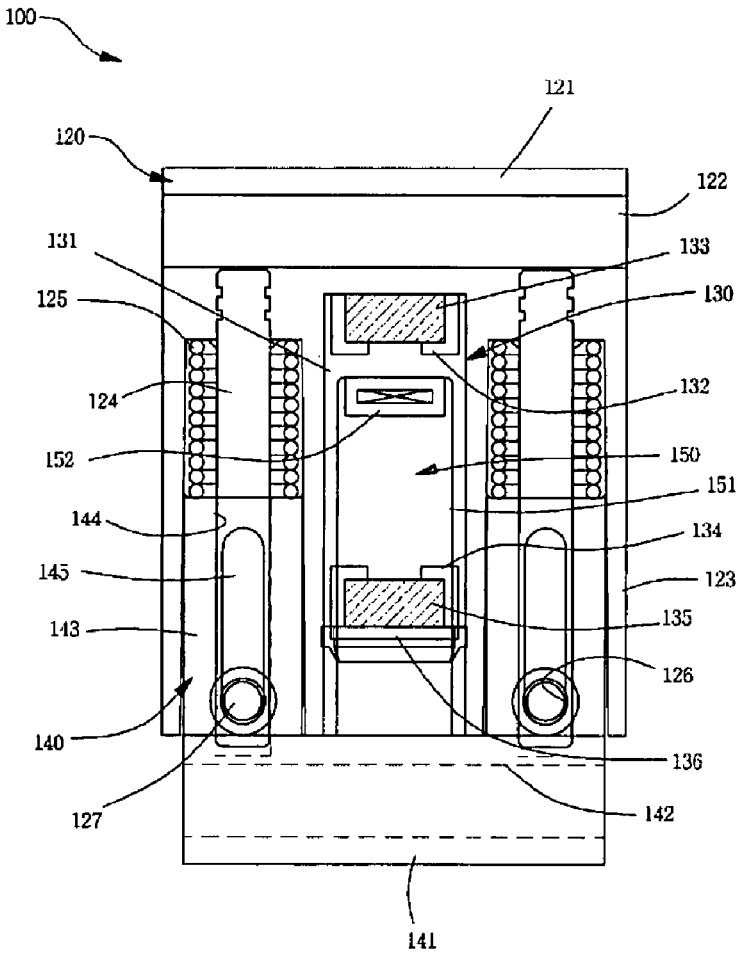

[Fig. 5]
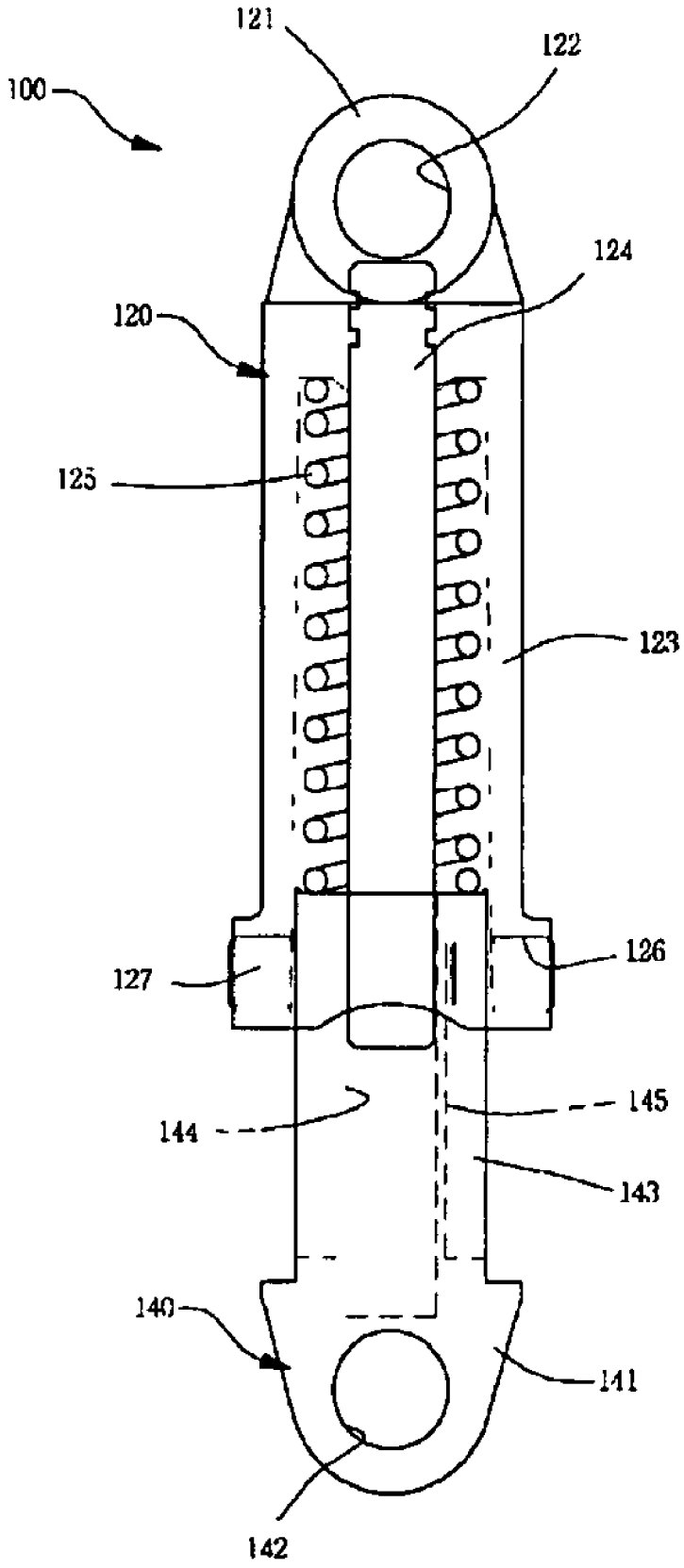

[Fig. 6]
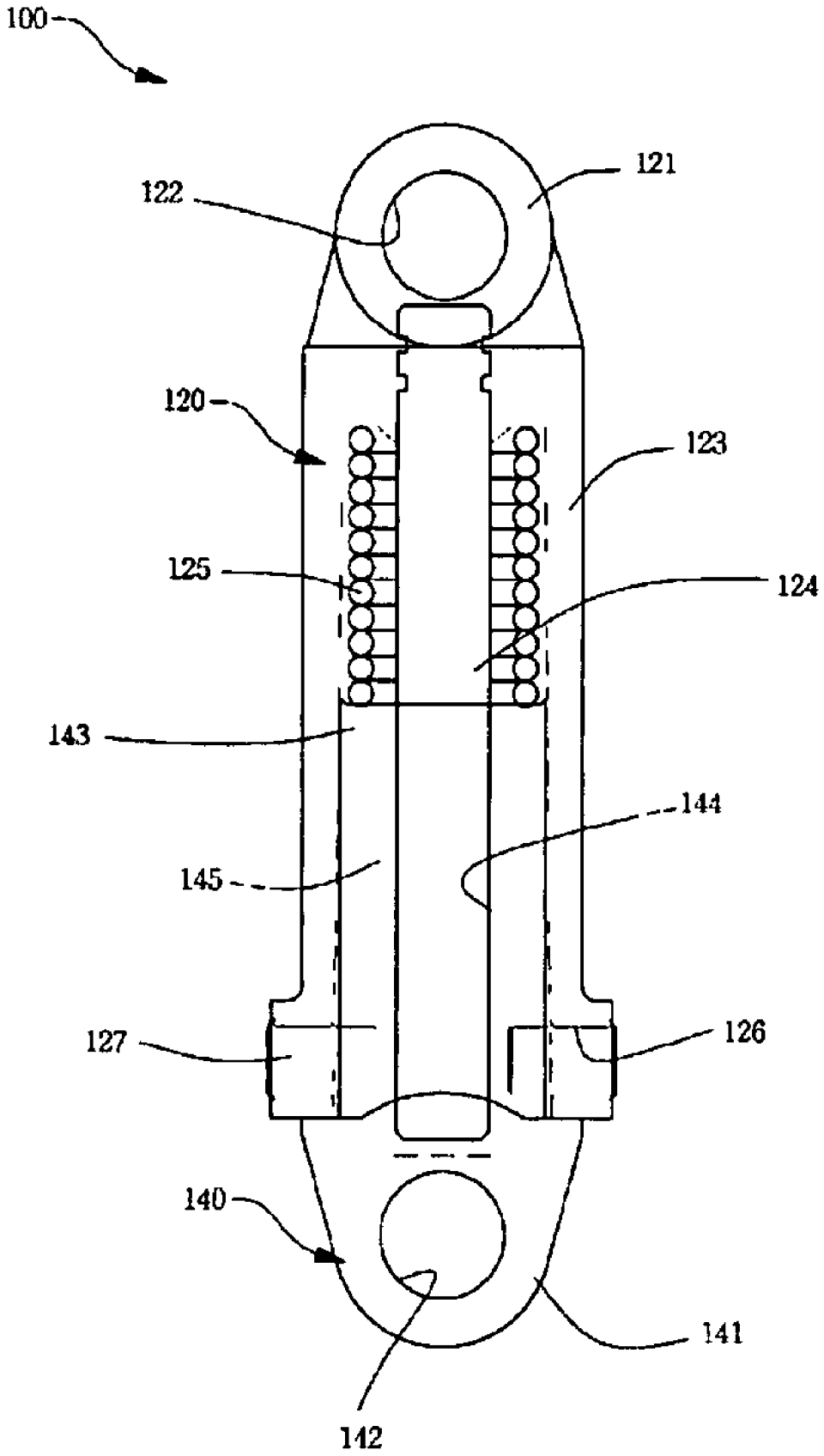

PEDAL EQUIPPED WITH DISPLACEMENT DETECTING SENSOR USING LIKE MAGNETIC POLES

CROSS-REFERENCE TO RELATED APPLICATIONS

This application is a 371 of international patent application PCT/KR2006/002506, filed Jun. 28, 2006, which is based upon and claims the benefit of priority from prior Korean Patent Application No. 20-2005-0018720, filed Jun. 28, 2005, and from prior Korean Patent Application No. 10-2006-0052856, filed Jun. 13, 2006, the entire contents of each are incorporated herein by reference.

TECHNICAL FIELD

The present invention relates generally to a pedal equipped with a displacement detecting sensor using like magnetic poles and, more particularly, to a pedal equipped with a displacement detecting sensor using like magnetic poles, which is constructed so that a plurality of shock-absorbing parts for absorbing shocks using a spring force extends from a center to a lower support part of the pedal for controlling various kinds of industrial machines or equipment, magnets are provided at the top dead center and the bottom dead center of the pedal in the center of the shock-absorbing parts such that like magnetic poles of the magnets face each other, and a sensing unit having a displacement sensor is provided between the upper and lower permanent magnets such that the position of the sensing unit changes in response to the motion of the pedal, thus the shock-absorbing parts absorb shocks caused by the manipulation of the pedal, and a position is sensed according to the variation in a magnetic field, generated around the facing like magnetic poles of the magnets, by the motion of the displacement sensor, therefore precisely sensing the operating position of the pedal and precisely controlling the industrial machines.

BACKGROUND ART

Generally, a pedal is part of a machine, has the shape of a board operated with the foot, and originates from the Latin language meaning the foot, 'pedals'. A bicycle transmits power sequentially from a pedal through a large gear and a chain to a driving wheel. Meanwhile, a car is operated by pressing an accelerator pedal, a brake pedal, and a clutch pedal.

As such, the pedal is a manipulating machine part which is used for an accelerator, a brake, or a clutch of a car or various kinds of construction equipment, such as industrial vehicles or fork lift trucks. The pedal is constructed to increase or reduce the operating force according to the strength of pressure applied by the foot, thus controlling the acceleration and the brake or clutch operation of various kinds of operating machines. The pedal is designed to detect the operating state of a machine according to the position of the pedal pressed by pressure.

As industrial transportation equipment, construction equipment, and a car, which are operated by pedals, become highly developed, new control equipment, that is, an Electronic Stability Program (ESP) has been developed to allow a user to operate the equipment or car from the best position while always checking a clutch, a brake, and an accelerating force according to the speed, the steering angle of a steering wheel, and the operation of the pedals. Thereby, the optimum driving position can be maintained without artificial manipulation. An Electronic Control Unit (ECU) serving as a central brain of the ESP has a central processing control circuit therein, thus automatically manipulating an optimum driving state, based on the data detected by sensors which check the variation in speed, braking operation, clutch operation, variation in temperature, the condition of an engine, the variation in rotation of wheels, and the condition of electronic parts, which affect a vehicle.

ECUs are attached to the four wheels of a car, respectively. When understeer or oversteer of the car occurs, the rotation of the wheels is controlled according to the input program. Thus, even if a driver abruptly manipulates a steering wheel when the car is running, the ECUs function to control the rotation of the four wheels so that the car does not seriously lean or roll over. The ECUs are a technology that is essential to impart intelligence to a car. The ECUs are an important technology for improving a driver's safety and minimizing accidents due to lack of driving experience. The applicable field of the ECUs is gradually expanding, thus the ECUs are being applied to industrial transportation equipment and construction equipment.

As such, among the sensors collecting various data, a Throttle Position Sensor (TPS) for measuring acceleration amount is attached to a throttle body in front of an intake manifold. When an accelerator pedal is pressed, the TPS detects a length corresponding to a pressed amount. The length is measured by a rotary variable resistor which measures a rotating angle according to the variation in opening ratio corresponding to the amount the pedal is pressed, and thus an analogue signal is generated. The TPS determines the engine condition based on the analogue signal and controls the amount of fuel injected.

A sensor using a pedal has a structure similar to that of the TPS. Such a sensor measures the rotating angle of the throttle body which is operated by the pedal and the variation in the operational ratio of the accelerator pedal. However, it is difficult to precisely measure the correlation between the throttle body and the accelerator pedal using the rotary variable resistance sensor, so that it is impossible to correctly control the fuel injection amount.

Further, the sensor using the pedal relatively precisely senses operating parts.

However, it is impossible to precisely measure variation in the operational ratio of the pedal.

Moreover, the rotary variable resistance sensor used to measure the distance the pedal is pressed cannot finely measure the variation in pressure when the pedal moves downwards and upwards, so that it is impossible to sense small motions.

DISCLOSURE OF INVENTION

Technical Problem

Accordingly, the present invention has been made keeping in mind the above problems occurring in the prior art, and an object of the present invention is to provide a pedal equipped with a displacement detecting sensor using like magnetic poles, which is constructed so that a lower support plate and an upper actuating pedal of a pedal unit for controlling various kinds of industrial machines and equipment are coupled to each other via an operating hinge, a sensor inserting unit is provided at a center under the actuating pedal, has on opposite sides thereof shock-absorbing cylinders each having a shock-absorbing spring, and has permanent magnets at the top dead center, corresponding to the position of the actuating pedal when at the top, and at the bottom dead center, corresponding to the position of the actuating pedal when at the bottom, due to a pressing pressure such that like magnetic poles of the permanent magnets face each other, a sensing unit having a displacement sensor is provided between the top and bottom dead centers of the permanent magnets, and insertion rods provided on opposite sides of the sensing unit and inserted into the corresponding shock-absorbing cylinders are coupled to the lower support plate via a coupling hinge, so that the insertion rods are moved by the operating distance of the actuating pedal between the permanent magnets which are provided between the actuating pedal and the support plate and are located at the top and bottom dead centers such that like magnetic poles thereof face each other, thus precisely and finely sensing the operating position of the pedal, according to the variation in magnetic force of the facing like magnetic poles detected by the displacement sensor, therefore enhancing sensing efficiency.

Another object of the present invention is to provide a pedal equipped with a displacement detecting sensor using like magnetic poles, in which a shock-absorbing unit is coupled to the lower portion of an actuating pedal via a shock-absorbing hinge to actuate the actuating pedal by applying pressure with the foot, is provided between a lower support plate and the actuating pedal actuated by the pressure of the foot, and has on both sides thereof shock-absorbing cylinders each having a shock-absorbing spring, and insertion rods are coupled to the upper portion of the support plate via a coupling hinge located at a position corresponding to the shock-absorbing hinge, and are inserted into the corresponding shock-absorbing cylinders, so that the shock-absorbing unit absorbs shocks even if strong pressure acts on the pedal, thus preventing the pedal from breaking or getting damaged, therefore increasing the life-span of the pedal, minimizing the fatigue of the foot operating the pedal, and increasing a user's comfort.

A further object of the present invention is to provide a pedal equipped with a displacement detecting sensor using like magnetic poles, in which a displacement sensor is provided between upper and lower permanent magnets that are located at the top and bottom dead centers of an actuating pedal which moves up and down, and detects displacement of the actuating pedal, thus measuring fine changes in a magnetic field so as to have high sensitivity, and allowing voltages of output signals for the detected displacement to be variously selected, therefore outputting a fine sensing value as a precise signal, and increasing sensing efficiency.

Yet another object of the present invention is to provide a pedal equipped with a displacement detecting sensor using like magnetic poles, in which upper and lower permanent magnets located at the top and bottom dead centers of an actuating pedal which moves up and down are arranged such that like magnetic poles thereof face each other, thus preventing the permanent magnets from passing through a displacement sensor, and causing the intensity of a magnetic field detected by the displacement sensor to be in proportion to the displacement, therefore precisely measuring displacement and increasing reliability.

A still further object of the present invention is to provide a pedal equipped with a displacement detecting sensor using like magnetic poles, in which an insertion rod having a longitudinal locking hole and provided at a predetermined position of a rod unit, which is coupled to the upper portion of a support plate via a coupling hinge, is inserted into each of two shock-absorbing cylinders which have shock-absorbing springs and are provided on both sides of a shock-absorbing unit coupled to the lower portion of an actuating pedal via a shock-absorbing hinge, and a locking part is locked to a locking hole formed at a predetermined position in each of the shock-absorbing cylinders and the longitudinal locking hole of the road unit, so that the actuating pedal is moved up and down within the range of the longitudinal locking hole, thus preventing the removal of the actuating pedal, therefore maximizing a shock-absorbing effect.

Technical Solution

In order to accomplish the above objects, the present invention provides a pedal equipped with a displacement detecting sensor using like magnetic poles, including a pedal unit which includes a support plate having a shape of a rectangular plate and supporting a lower portion of the pedal, an actuating pedal coupled to an end of the support plate via an operating hinge and actuated by pressing pressure, a shock-absorbing hinge provided on a lower portion of the actuating pedal, and a coupling hinge provided on an upper portion of the support plate and positioned to correspond to the shock-absorbing hinge when the actuating pedal is actuated, a shock-absorbing unit which includes a shock-absorbing mounting part provided on an upper portion of the shock-absorbing unit and having a shock-absorbing mounting hole such that the shock-absorbing hinge of the pedal unit is mounted to the shock-absorbing mounting part, a support shaft provided in a center of each of shock-absorbing cylinders having hollow space therein, the shock-absorbing cylinders being provided on both sides of a lower portion of the shock-absorbing unit to be spaced apart from each other by a predetermined interval, and a shock-absorbing spring provided in each of the shock-absorbing cylinders to be supported by the support shaft, a sensor inserting unit which includes an insertion housing provided in a center of the shock-absorbing unit to be positioned between the shock-absorbing cylinders and having a shape of a rectangular box, an upper permanent magnet seated in an upper support seat provided at an upper position in the insertion housing, a lower permanent magnet seated in a lower support seat provided at a lower position in the insertion housing, and a sensor support provided at a lower position in the insertion housing, a rod unit which includes a rod mounting part having a rod mounting hole coupled to the coupling hinge, the coupling hinge being provided on the upper portion of the support plate of the pedal unit, and cylindrical insertion rods provided on both sides on an upper portion of the rod mounting part in such a way as to be coupled to the corresponding shock-absorbing cylinders, each of the cylindrical insertion rods having at a center thereof an insertion hole such that the support shaft is inserted therein, supporting the shock-absorbing spring, and being inserted into each of the shock-absorbing cylinders, and a sensing unit which includes a sensor housing provided at a center in the rod unit to be positioned between the insertion rods and extending from the rod mounting part, and a displacement sensor provided on an upper portion of the sensor housing to detect a magnetic field, so that, when the insertion rods are inserted into the corresponding shock-absorbing cylinders, the displacement sensor is supported by the sensor support of the sensor inserting unit, and is moved up and down in response to operation of the actuating pedal, thus measuring displacement amount of a magnetic field formed between the upper permanent magnet and the lower permanent magnet, therefore sensing a position of the actuating pedal.

Further, a locking hole is formed at a predetermined position in each of the shock-absorbing cylinders of the shock-absorbing unit, and a longitudinal locking hole is formed in the insertion rod inserted into each of the shock-absorbing cylinders to be positioned around the locking hole, so that, when the locking hole and the longitudinal locking hole are placed at a predetermined position, a locking part is inserted into the locking hole and the longitudinal locking hole, thus vertically reciprocating the insertion rod inserted into each of the shock-absorbing cylinders within a range of the longitudinal locking hole.

Furthermore, the upper permanent magnet and the lower permanent magnet, seated, respectively, in the upper support seat and the lower support seat provided in the insertion housing of the sensor inserting unit, are arranged such that like magnetic poles thereof face each other, so that the displacement sensor of the sensing unit is operated in conjunction with the actuating pedal, thus sensing displacement of the magnetic field according to position change.

BRIEF DESCRIPTION OF THE DRAWINGS

The above and other objects, features and advantages of the present invention will be more clearly understood from the following detailed description taken in conjunction with the accompanying drawings, in which:

FIG. 1 is a side view showing a pedal equipped with a displacement detecting sensor using like magnetic poles, according to the present invention;

FIG. 2 is a front sectional view showing a shock-absorbing unit which is an important part of the pedal equipped with the displacement detecting sensor using the like magnetic poles, according to the present invention, in which a sensor inserting unit is provided in the shock absorbing unit;

FIG. 3 is a front sectional view showing a rod unit which is an important part of the pedal equipped with the displacement detecting sensor using the like magnetic poles, according to the present invention, in which a sensing unit is attached to the rod unit;

FIG. 4 is a view showing the shock-absorbing unit and the rod unit, which are important parts of the pedal equipped with the displacement detecting sensor using like magnetic poles, according to the present invention, when the shock-absorbing unit and the rod unit are assembled with each other;

FIG. 5 is a side sectional view showing the state where the shock-absorbing unit and the rod unit, which are important parts of the pedal equipped with the displacement detecting sensor using like magnetic poles, according to the present invention, are assembled with each other and the rod unit is at top dead center, so that the pedal is not used; and FIG. 6 is a side sectional view showing the state where the shock-absorbing unit and the rod unit, which are important parts of the pedal equipped with the displacement detecting sensor using like magnetic poles, according to the present invention, are assembled with each other and the rod unit is inserted into the shock-absorbing unit, so that the pedal is not used.

MODE FOR THE INVENTION

Reference now should be made to the drawings, in which the same reference numerals are used throughout the different drawings to designate the same or similar components.

FIG. 1 is a side view showing a pedal equipped with a displacement detecting sensor using like magnetic poles, according to the present invention, FIG. 2 is a front sectional view showing a shock-absorbing unit which is an important part of the pedal equipped with the displacement detecting sensor using the like magnetic poles, according to the present invention, in which a sensor inserting unit is provided in the shock absorbing unit, FIG. 3 is a front sectional view showing a rod unit which is an important part of the pedal equipped with the displacement detecting sensor using the like magnetic poles, according to the present invention, in which a sensing unit is attached to the rod unit, FIG. 4 is a view showing the shock-absorbing unit and the rod unit, which are important parts of the pedal equipped with the displacement detecting sensor using like magnetic poles, according to the present invention, when the shock-absorbing unit and the rod unit are assembled with each other, FIG. 5 is a side sectional view showing the state where the shock-absorbing unit and the rod unit, which are important parts of the pedal equipped with the displacement detecting sensor using like magnetic poles, according to the present invention, are assembled with each other and the rod unit is at top dead center, so that the pedal is not used, and FIG. 6 is a side sectional view showing the state where the shock-absorbing unit and the rod unit, which are important parts of the pedal equipped with the displacement detecting sensor using like magnetic poles, according to the present invention, are assembled with each other and the rod unit is inserted into the shock-absorbing unit, so that the pedal is not used.

As shown in FIGS. 1 to 6, a pedal 100 equipped with a displacement detecting sensor using like magnetic poles, according to the present invention, includes a pedal unit 110, a shock-absorbing unit 120, a sensor inserting unit 130, a rod unit 140, and a sensing unit 150. The pedal unit 110 includes an actuating pedal 111 having the shape of a rectangular plate which is inclined at a predetermined angle so as to manipulate various kinds of industrial machines or equipment. The lower portion of the pedal unit 110 is supported by a support plate 112 which is hinged to the actuating pedal 111 via an operating hinge 113. The shock-absorbing unit 120 is coupled to the lower portion of the actuating pedal 111 of the pedal unit 110 via a shock-absorbing hinge 114. Shock-absorbing cylinders 123 each having a shock-absorbing spring 125 are provided on both sides of the shock-absorbing unit 120. The sensor inserting unit 130 is provided in the center of the shock-absorbing unit 120, and includes upper and lower permanent magnets 133 and 135 which cause variation in a magnetic field when the actuating pedal 111 is moved up and down. The rod unit 140 is mounted to the upper portion of the support plate 112 of the pedal unit 110 via a coupling hinge 115. Both sides of the rod unit 140 are inserted into the corresponding shock-absorbing cylinders 123. The sensing unit 150 is provided in the center of the rod unit 140 to be inserted into the sensor inserting unit 130, and measures variation in a magnetic field due to the upward or downward movement of the actuating pedal 111.

The pedal unit 110 includes the support plate 112 which has the shape of a rectangular plate and supports the lower portion of the pedal unit 110. The actuating pedal 111 is hinged to a predetermined position on the support plate 112 using the operating hinge 113, thus realizing a pedal unit 110 that is actuated by pressing pressure. The shock-absorbing hinge 114 is provided on the lower portion of the actuating pedal 111. The coupling hinge 115 is provided on the upper portion of the support plate 112 to be located at a position corresponding to the shock-absorbing hinge 114 when the actuating pedal 111 is actuated.

The shock-absorbing unit 120 has on an upper portion thereof a shock-absorbing mounting part 121 having a shock-absorbing mounting hole 122 so as to be mounted to the shock-absorbing hinge 114 of the pedal unit 110. The shock-absorbing cylinders 123 are provided on both sides of the lower portion of the shock-absorbing unit 120 to be spaced apart from each other by a predetermined interval, and have hollow space therein so that support shafts 124 are provided in the space of the corresponding shock-absorbing cylinders 123. A shock-absorbing spring 125 is provided in each of the shock-absorbing cylinders 123, and is supported by the corresponding support shaft 124.

The sensor inserting unit 130 includes an insertion housing 131 which has the shape of a rectangular box and is provided in the center of the shock-absorbing unit 120 to be located between the shock-absorbing cylinders 123. The upper permanent magnet 133 is seated in an upper support seat 132 which is provided at an upper position in the insertion housing 131. Further, the lower permanent magnet 135 is seated in a lower support seat 134 which is provided at a lower position in the insertion housing 131. A sensor support 136 is provided at a lower position of the insertion housing 131.

The rod unit 140 has a rod mounting part 141 which has a rod mounting hole 142 and is mounted to the coupling hinge 115 provided on the upper portion of the support plate 112. Cylindrical insertion rods 143 are provided on both sides of the upper portion of the rod unit 140 to be coupled to the corresponding shock-absorbing cylinders 123. The cylindrical insertion rods 143 have insertion holes 144 so that the support shafts 124 are inserted into the corresponding insertion holes 144. Thereby, the insertion rods 143 are inserted into the shock-absorbing cylinders 123 while supporting the shock-absorbing springs 125.

Preferably, a locking hole 126 is formed in a predetermined portion of each shock-absorbing cylinder 123 of the shock-absorbing unit 120. In the state in which each insertion rod 143 is inserted into the corresponding shock-absorbing cylinder 123, a longitudinal locking hole 145 is formed in the insertion rod 143 inserted into the shock-absorbing cylinder 123 to be located around the locking hole 126. Thereby, the locking hole 126 and the longitudinal locking hole 145 are placed at predetermined positions. Next, a locking part 127 is inserted into the aligned locking hole 126 and longitudinal locking hole 145. Thereby, the insertion rod 143 inserted into each shock-absorbing cylinder 123 reciprocates in a vertical direction within the longitudinal locking hole 145.

The sensing unit 150 includes a sensor housing 151 which is provided in the center of the rod unit 140 to be located between the insertion rods 143 and extends upwards from the rod mounting part 141. A displacement sensor 152 is provided on the upper portion of the sensor housing 151 to detect a magnetic field. When the insertion rods 143 are inserted into the corresponding shock-absorbing cylinders 123, the displacement sensor 152 is supported by the sensor support 136 of the sensor inserting unit 130, and moves up and down in response to the operation of the actuating pedal 111. In this way, the displacement sensor 152 measures the displacement of the magnetic field generated between the upper and lower permanent magnets 133 and 135, thus sensing the position of the actuating pedal 111.

Preferably, the upper permanent magnet 133 seated in the upper support seat 132 and the lower permanent magnet 135 seated in the lower support seat 134 are provided in the insertion housing 131 of the sensor inserting unit 130 such that like magnetic poles thereof face each other. Thereby, the displacement sensor 152 of the sensing unit 150 is operated in conjunction with the actuating pedal 111, thus sensing the displacement of a magnetic field, according to the change in position.

The operation of the pedal equipped with the displacement detecting sensor using like magnetic poles, according to the present invention, will be described below.

First, the support plate 112 of the pedal unit 110 is arranged such that the pedal is mounted to an industrial machine or equipment to be operated. Afterwards, the actuating pedal 111 is coupled to the support plate 112 using the operating hinge 113 provided at a predetermined position on the support plate 112. In such a state, the shock-absorbing hinge 114 provided on the lower portion of the actuating pedal 111 is inserted into the shock-absorbing mounting hole 122 of the shock-absorbing mounting part 121 of the shock-absorbing unit 120.

The support shafts 124 are inserted into the hollow space defined in the shock-absorbing cylinders 123 of the shock-absorbing unit 120 which is coupled to the actuating pedal 111. The shock-absorbing springs 125 are installed in the space defined in the shock-absorbing cylinders 123 to support the corresponding support shafts 124. The upper permanent magnet 133 seated in the upper support seat 132 and the lower permanent magnet 135 seated in the lower support seat 134 are installed, respectively, at upper and lower positions in the sensor inserting unit 130 provided between the shock-absorbing cylinders 123, to correspond to the upper and lower operation heights of the actuating pedal 111.

As such, the shock-absorbing unit 120 having at the center on the lower portion thereof the sensor inserting unit 130 is coupled to the actuating pedal 111. In such a state, when the support shafts 124 of the shock-absorbing unit 120 are inserted into the corresponding insertion holes 144 of the rod unit 140, the insertion rods 143 are inserted into the shock-absorbing cylinders 123 while being elastically supported by the shock-absorbing springs 125. The longitudinal locking hole 145 formed in one end of each insertion rod 143 is aligned with the locking hole 126 bored in each shock-absorbing cylinder 123. In such a state, the rod unit 140 is locked to the shock-absorbing unit 120 via the locking parts 127 such that the rod unit 140 moves in the shock-absorbing cylinders 123 a distance corresponding to the length of each longitudinal locking hole 145.

As such, when the rod unit 140 is locked to the shock-absorbing cylinders 123, the sensing unit 150, having the displacement sensor 152 on the upper portion of the sensor housing 151 which is provided at the center of the rod unit 140 and extends from the rod mounting part 141, is located at the sensor support 136 which is provided on the lower portion of the sensor inserting unit 130. Thereby, the displacement sensor 152 is mounted between the upper and lower permanent magnets 133 and 135.

In this case, like magnetic poles of the upper and lower permanent magnets 133 and 135 face each other such that magnetic fields of the upper and lower permanent magnets 133 and 135 repel each other. Thereby, the magnetic field uniformly changes in response to the displacement of the displacement sensor 152, thus finely and precisely detecting the position of the pedal.

As such, the rod unit 140 and the sensing unit 150 are inserted into the shock-absorbing unit 120 and the sensor inserting unit 130, respectively. In such a state, the coupling hinge 115 provided on the upper portion of the support plate 112, which is mounted to the lower portion of the pedal, is inserted into the rod mounting hole 142 formed in the rod mounting part 141 which is provided on the lower portion of the rod unit 140. Thereby, the installation of the pedal is completed.

After the installation of the pedal 100 is completed, when the displacement sensor 152, located between the upper and lower permanent magnets 133 and 135 which are provided in the sensor inserting unit 13, is operated in conjunction with the pedal 100 so that the position of the displacement sensor is changed, the magnetic-field displacement of the upper and lower permanent magnets 133 and 135 is sensed by the displacement sensor 152. An output signal value according to the operation angle of the pedal 100 is output to the exterior.

In a detailed description, assuming that the maximum and minimum output signal values required by a user are limited within the range from 0.5V to 4.5V, and the output signal values obtained by the operation of the pedal 100 are delivered to the exterior, the displacement sensor is set such that the output signal value for the magnetic-field displacement is 0.5V when the pedal 100 is not operated. Further, the displacement sensor is set such that the output signal value for the magnetic-field displacement is 4.5V when the pedal 100 is pressed to the maximum. Thus, the magnetic-field displacement of the upper and lower permanent magnets 133 and 135, varying in response to the operation of the pedal 100, is sensed by the displacement sensor 152, prior to delivering the output signal value in proportion to the operating position.

After the setting operation has been completed as desired, the actuating pedal 111 is pressed to manipulate the pedal 100. At this time, the actuating pedal 111 rotates about the operating hinge 113 of the support plate 112 to move downwards. Thereby, each insertion rod 143 of the rod unit 140, which supports the shock-absorbing spring 125 in the corresponding shock-absorbing cylinder 123 coupled to the lower portion of the actuating pedal 111 via the shock-absorbing hinge 114 and is hinged via the coupling hinge 115 to the upper portion of the support plate 112, enters the shock-absorbing cylinder 123. At this time, the shock applied by the actuating pedal 111 is absorbed by the shock-absorbing springs 125.

As the actuating pedal 111 is actuated, the displacement sensor 152 of the sensing unit 150 coupled to the rod unit 140 moves into the sensor inserting unit 130 provided between the shock-absorbing cylinders 123, so that the position of the displacement sensor 152 is changed. At this time, the magnetic-field displacement of the upper and lower permanent magnets 133 and 135 provided such that like magnetic poles thereof face each other is detected by the displacement sensor 152, so that the operating position of the actuating pedal 151 is sensed.

When the actuating pedal 111 moves downwards to the maximum bottom dead center, the locking part 127 provided at a predetermined position on each shock-absorbing cylinder 123 is locked to the longitudinal locking hole 145 formed in a corresponding position of each insertion rod 143. When the locking part reaches the lower end of the stroke, limited by the size of the longitudinal locking hole, the locking part stops moving. Thereby, the actuating pedal 111 moves downwards to the bottom dead center.

At this time, the displacement sensor 152 moves downwards to the lower permanent magnet 135 of the sensor inserting unit 130 provided at a position corresponding to the bottom dead center. As the downward movement of the actuating pedal 111 to the bottom dead center is detected, the operation of the actuating pedal 111 is sensed by the displacement sensor 152.

When pressure is released from the actuating pedal 111 which has moved downwards, each insertion rod 143 is compressed by the elasticity of the corresponding shock-absorbing spring 125 provided in each shock-absorbing cylinder 123. Thereby, each locking part 127 of the shock-absorbing unit 120 is locked to the corresponding longitudinal locking hole 145 of the rod unit 140, so that the locking part 127 reaches the upper end of the stroke limited by the size of the longitudinal locking hole and stops operating. As a result, the actuating pedal 111 moves upwards and returns to its original position.

At this time, the displacement sensor 152 moves upwards to the upper permanent magnet 133 of the sensor inserting unit 130 provided at a position corresponding to the top dead center, thus detecting the time at which the actuating pedal 111 returns to its original position.

Thus, when pressure is applied to the actuating pedal 111, the shock is absorbed by the shock-absorbing springs 125, and the displacement sensor 152 is operated together. Thereby, the amount of variation of the position of the actuating pedal 111 is sensed in response to the change in the magnetic field of the upper and lower permanent magnets 133 and 135. Shocks are absorbed, thus increasing the life-span of the pedal, and the position of the actuating pedal 111 is precisely sensed, thus enhancing the sensing capacity of the pedal.

INDUSTRIAL APPLICABILITY

As described above, the present invention provides a pedal equipped with a displacement detecting sensor using like magnetic poles, which is constructed so that a lower support plate and an upper actuating pedal of a pedal unit for controlling various kinds of industrial machines and equipment are coupled to each other via an operating hinge, a sensor inserting unit is provided at a center under the actuating pedal, has on opposite sides thereof shock-absorbing cylinders each having a shock-absorbing spring, and has permanent magnets at the top dead center, corresponding to the position of the actuating pedal when at the top, and at the bottom, dead center, corresponding to the position of the actuating pedal when at the bottom, due to a pressing pressure such that like magnetic poles of the permanent magnets face each other, a sensing unit having a displacement sensor is provided between the top and bottom dead centers of the permanent magnets, and insertion rods provided on opposite sides of the sensing unit and inserted into the corresponding shock-absorbing cylinders are coupled to the lower support plate via a coupling hinge, so that the insertion rods are moved by the operating distance of the actuating pedal between the permanent magnets which are provided between the actuating pedal and the support plate and are located at the top and bottom dead centers such that like magnetic poles thereof face each other, thus precisely and finely sensing the operating position of the pedal, according to the variation in magnetic force of the facing like magnetic poles detected by the displacement sensor, therefore enhancing sensing efficiency.

Further, the invention provides a pedal equipped with a displacement detecting sensor using like magnetic poles, in which a shock-absorbing unit is coupled to the lower portion of an actuating pedal via a shock-absorbing hinge to actuate the actuating pedal by applying pressure with the foot, is provided between a lower support plate and the actuating pedal actuated by the pressure of the foot, and has on both sides thereof shock-absorbing cylinders each having a shock-absorbing spring, and insertion rods are coupled to the upper portion of the support plate via a coupling hinge located at a position corresponding to the shock-absorbing hinge, and are inserted into the corresponding shock-absorbing cylinders, so that the shock-absorbing unit absorbs shocks even if strong pressure acts on the pedal, thus preventing the pedal from breaking or getting damaged, therefore increasing the life-span of the pedal, minimizing the fatigue of the foot operating the pedal, and increasing a user's comfort.

Further, the present invention provides a pedal equipped with a displacement detecting sensor using like magnetic poles, in which a displacement sensor is provided between upper and lower permanent magnets that are located at the top and bottom dead centers of an actuating pedal which moves up and down, and detects displacement of the actuating pedal, thus measuring fine changes in a magnetic field so as to have high sensitivity, and allowing voltages of output signals for the detected displacement to be variously selected, therefore outputting a fine sensing value as a precise signal, and increasing sensing efficiency.

Furthermore, the present invention provides a pedal equipped with a displacement detecting sensor using like magnetic poles, in which upper and lower permanent magnets located at the top and bottom dead centers of an actuating pedal which moves up and down are arranged such that like magnetic poles thereof face each other, thus preventing the permanent magnets from passing through a displacement sensor, and causing the intensity of a magnetic field detected by the displacement sensor to be in proportion to the displacement, therefore precisely measuring displacement and increasing reliability.

Moreover, the present invention provides a pedal equipped with a displacement detecting sensor using like magnetic poles, in which an insertion rod having a longitudinal locking hole and provided at a predetermined position of a rod unit, which is coupled to the upper portion of a support plate via a coupling hinge, is inserted into each of two shock-absorbing cylinders which have shock-absorbing springs and are provided on both sides of a shock-absorbing unit coupled to the lower portion of an actuating pedal via a shock-absorbing hinge, and a locking part is locked to a locking hole formed at a predetermined position in each of the shock-absorbing cylinders and the longitudinal locking hole of the road unit, so that the actuating pedal is moved up and down within the range of the longitudinal locking hole, thus preventing the removal of the actuating pedal, therefore maximizing a shock-absorbing effect.

The invention claimed is:

1. A pedal equipped with a displacement detecting sensor using like magnetic poles, comprising: a pedal unit, comprising: a support plate having a shape of a rectangular plate, and supporting a lower portion of the pedal; an actuating pedal coupled to an end of the support plate via an operating hinge, and actuated by pressing pressure; a shock-absorbing hinge provided on a lower portion of the actuating pedal; and a coupling hinge provided on an upper portion of the support plate, and positioned to correspond to the shock-absorbing hinge when the actuating pedal is actuated; a shock-absorbing unit, comprising: a shock-absorbing mounting part provided on an upper portion of the shock-absorbing unit, and having a shock-absorbing mounting hole such that the shock-absorbing hinge of the pedal unit is mounted to the shock-absorbing mounting part; a support shaft provided in a center of each shock-absorbing cylinders having hollow space therein, the shock-absorbing cylinders being provided on both sides of a lower portion of the shock-absorbing unit to be spaced apart from each other by a predetermined interval; and a shock-absorbing spring provided in each of the shock-absorbing cylinders to be supported by the support shaft; a sensor inserting unit, comprising: an insertion housing provided in a center of the shock-absorbing unit to be positioned between the shock-absorbing cylinders, and having a shape of a rectangular box; an upper permanent magnet seated in an upper support seat provided at an upper position in the insertion housing; a lower permanent magnet seated in a lower support seat provided at a lower position in the insertion housing; and a sensor support provided at a lower position in the insertion housing; a rod unit, comprising: a rod mounting part having a rod mounting hole coupled to the coupling hinge, the coupling hinge being provided on the upper portion of the support plate of the pedal unit; and cylindrical insertion rods provided on both sides on an upper portion of the rod mounting part in such a way as to be coupled to the corresponding shock-absorbing cylinders, each of the cylindrical insertion rods having at a center thereof an insertion hole such that the support shaft is inserted therein, supporting the shock-absorbing spring, and being inserted into each of the shock-absorbing cylinders; and a sensing unit, comprising: a sensor housing provided at a center in the rod unit to be positioned between the insertion rods, and extending from the rod mounting part; and a displacement sensor provided on an upper portion of the sensor housing to detect a magnetic field, so that, when the insertion rods are inserted into the corresponding shock-absorbing cylinders, the displacement sensor is supported by the sensor support of the sensor inserting unit, and is moved up and down in response to operation of the actuating pedal, thus measuring displacement amount of a magnetic field formed between the upper permanent magnet and the lower permanent magnet, therefore sensing a position of the actuating pedal.

2. The pedal as set forth in claim 1, wherein a locking hole is formed at a predetermined position in each of the shock-absorbing cylinders of the shock-absorbing unit, and a longitudinal locking hole is formed in the insertion rod inserted into each of the shock-absorbing cylinders to be positioned around the locking hole, so that, when the locking hole and the longitudinal locking hole are placed at a predetermined position, a locking part is inserted into the locking hole and the longitudinal locking hole, thus vertically reciprocating the insertion rod inserted into each of the shock-absorbing cylinders within a range of the longitudinal locking hole.

3. The pedal as set forth in claim 1, wherein the upper permanent magnet and the lower permanent magnet, seated, respectively, in the upper support seat and the lower support seat provided in the insertion housing of the sensor inserting unit, are arranged such that like magnetic poles thereof face each other, so that the displacement sensor of the sensing unit is operated in conjunction with the actuating pedal, thus sensing displacement of the magnetic field according to position change.

* * * * *